US008726578B2

(12) United States Patent
Thielke et al.

(10) Patent No.: US 8,726,578 B2
(45) Date of Patent: May 20, 2014

(54) PARTITION SYSTEM

(75) Inventors: Mark A. Thielke, Menomonee Falls, WI (US); Thomas S. Persick, New Berlin, WI (US); Midchi K. Odya, Jackson, WI (US)

(73) Assignee: The Mills Company, Sandusky, OH (US)

( * ) Notice: Subject to any disclaimer, the term of this patent is extended or adjusted under 35 U.S.C. 154(b) by 0 days.

(21) Appl. No.: 13/183,223

(22) Filed: Jul. 14, 2011

(65) Prior Publication Data

US 2011/0265385 A1 Nov. 3, 2011

Related U.S. Application Data

(63) Continuation of application No. 12/167,042, filed on Jul. 2, 2008, now Pat. No. 7,987,635.

(60) Provisional application No. 60/948,175, filed on Jul. 5, 2007.

(51) Int. Cl.
*E04H 6/06* (2006.01)

(52) U.S. Cl.
USPC ..... 52/32; 52/36.1; 52/36.5; 52/205; 52/65; 49/402; 49/382

(58) Field of Classification Search
USPC ..... 52/34, 36.1, 238.1, 239, 241, 205, 36.5, 52/32, 65; 160/130, 180, 181, 210, 220, 160/160; 49/381, 382, 397, 398, 400, 401, 49/402
See application file for complete search history.

(56) References Cited

U.S. PATENT DOCUMENTS

| | | | |
|---|---|---|---|
| 460,344 | A | 9/1891 | O'Connell |
| 1,259,358 | A | 3/1918 | Carpenter |
| 1,304,013 | A | 5/1919 | Betz |
| 1,501,320 | A | 7/1924 | Drachenberg |

(Continued)

FOREIGN PATENT DOCUMENTS

| | | | |
|---|---|---|---|
| DE | 25 01 759 | | 7/1976 |
| DE | 298 00 269 | | 4/1998 |
| GB | 2 214 213 | A | 0/1900 |
| GB | 2214213 | A * | 8/1989 |

OTHER PUBLICATIONS

Intellectual Property Office Examination Report for Application No. GB0922327.2, Report Date Jul. 7, 2011, 2 pages.

(Continued)

*Primary Examiner* — Robert Canfield
*Assistant Examiner* — Matthew Gitlin
(74) *Attorney, Agent, or Firm* — Foley & Lardner LLP

(57) ABSTRACT

A partition system includes a first pilaster and a door coupled to the first pilaster and rotatable from a closed position to an open position. The door is configurable in a first configuration wherein the door is rotatable from the closed position to the open position in a first direction and prevented from rotating in a second direction from the closed position, the second direction opposite the first direction. The door is further configurable in a second configuration wherein the door is rotatable from the closed position to the open position in the second direction and prevented from rotating in the first direction from the closed position. The door is coupled to the first pilaster to define a seam and prevents a line of sight from being established through the seam.

14 Claims, 4 Drawing Sheets

(56) References Cited

U.S. PATENT DOCUMENTS

| | | | | | |
|---|---|---|---|---|---|
| 1,513,662 | A | | 10/1924 | Wheelock | |
| 1,720,143 | A | | 7/1929 | O'Connor | |
| 1,769,224 | A | | 7/1930 | Jones | |
| 1,778,434 | A | | 10/1930 | Smith | |
| 1,923,701 | A | | 8/1933 | Bohn | |
| 2,091,415 | A | * | 8/1937 | Mauser | 52/238.1 |
| 2,126,148 | A | | 8/1938 | Souza | |
| 2,175,717 | A | | 10/1939 | Kerr | |
| 2,188,123 | A | | 1/1940 | Patterson et al. | |
| 2,532,758 | A | | 12/1950 | Wallace | |
| 2,671,683 | A | | 3/1954 | Heyman et al. | |
| 2,742,119 | A | | 4/1956 | Combs et al. | |
| 2,776,029 | A | | 1/1957 | Warner | |
| 2,832,212 | A | | 4/1958 | Olsen | |
| 2,876,874 | A | | 3/1959 | Benham | |
| 2,978,755 | A | | 4/1961 | Walker | |
| 3,060,523 | A | * | 10/1962 | Benham | 49/381 |
| 3,104,428 | A | | 9/1963 | Benham | |
| 3,194,361 | A | | 7/1965 | Thurman | |
| 3,194,362 | A | | 7/1965 | Wargo | |
| 3,300,900 | A | * | 1/1967 | Risk et al. | 49/381 |
| 3,370,388 | A | | 2/1968 | Dielman | |
| 3,382,611 | A | | 5/1968 | Zandelin | |
| 3,537,687 | A | | 11/1970 | Adelman | |
| 3,732,653 | A | | 5/1973 | Pickett | |
| 3,768,207 | A | * | 10/1973 | Mongelli et al. | 49/503 |
| 3,813,836 | A | | 6/1974 | Dielman | |
| 3,962,827 | A | * | 6/1976 | Chaffee | 49/384 |
| 4,112,621 | A | | 9/1978 | Ehrhart et al. | |
| 4,881,353 | A | | 11/1989 | Braendel et al. | |
| 4,982,535 | A | | 1/1991 | Pickett | |
| 5,367,844 | A | | 11/1994 | Diedrich | |
| 5,437,065 | A | | 8/1995 | Sakawa | |
| 5,592,787 | A | | 1/1997 | Ophardt | |
| 5,630,302 | A | | 5/1997 | Rosenband | |
| 5,640,816 | A | | 6/1997 | Reiland et al. | |
| 5,711,121 | A | | 1/1998 | Garver | |
| 5,816,000 | A | | 10/1998 | Izatt et al. | |
| 5,873,205 | A | | 2/1999 | Hanlon et al. | |
| D424,217 | S | | 5/2000 | Beachy | |
| 6,151,852 | A | | 11/2000 | Linn et al. | |
| D459,493 | S | | 6/2002 | Thornton et al. | |
| 6,433,411 | B1 | | 8/2002 | Degani et al. | |
| 6,681,532 | B1 | | 1/2004 | Palmbos et al. | |
| 7,032,351 | B2 | | 4/2006 | Redman | |
| 7,152,257 | B2 | | 12/2006 | Lasch et al. | |
| 7,228,597 | B2 | | 6/2007 | Gerali et al. | |
| D623,769 | S | * | 9/2010 | Thielke et al. | D25/126 |
| 2003/0140572 | A1 | | 7/2003 | Hertzog et al. | |
| 2005/0050823 | A1 | | 3/2005 | Whitson | |
| 2005/0198910 | A1 | | 9/2005 | Keller | |
| 2005/0262770 | A1 | | 12/2005 | Warriner et al. | |
| 2007/0151164 | A1 | * | 7/2007 | Marshall | 49/397 |
| 2009/0007504 | A1 | * | 1/2009 | Thielke et al. | 52/205 |

OTHER PUBLICATIONS

Bradley Corporation, Mills Partitions, Commercial Washroom Innovation, Jan. 2006; 8 pages.

Bradley Corporation, Mills Partitions, Sep. 2001; 8 pages.

International Search Report and Written Opinion for International application No. PCT/US/2008/069062, date of mailing Dec. 15, 2008, 15 pages.

Photographs of Washroom Partitions, taken before Jul. 5, 2007; 9 pages.

Scranton Products (Santana/Comtec/Capitol), Toilet Compartments Product Information, printed on Sep. 14, 2007 from www.comtecindustries.com/Pages/prod1.htm, www.comtecindustries.com/Pages/prod1-6.htm, and www.comtecindustries.com/Pages/newdrawings.htm, believed to have been commercially available on or before May 4, 2006; 7 pages.

The Mills Company/Bradley Corporation, Baked Enamel & Stainless Steel Fastener Parts & Price List, bearing a designation "Jul. 24, 2007"; 22 pages.

The Mills Company/Bradley Corporation, Bradmar Fastener Parts & Price List for Sentinel—400 Series, bearing a designation "Aug. 11, 2005"; 12 pages.

The Mills Company/Bradley Corporation, Mills Partitions Technical Data for Restroom Partitions—Overview, bearing a designation "Jul. 8, 2004"; 1 page.

The Mills Company/Bradley Corporation, Phenolic Fastener Parts & Price List, bearing a designation "Apr. 3, 2006"; 12 pages.

The Mills Company/Bradley Corporation, Plastic Laminate Fastener Parts & Price List for 400 Series, 500 Series, 600 Series, and 700 Series, bearing a designation "Aug. 11, 2005"; 16 pages.

The Mills Company/Bradley Corporation, product brochure titled "Mills Partitions", displaying partition systems commercially available before Jul. 5, 2007; 6 pages.

* cited by examiner

PARTITION SYSTEM

CROSS-REFERENCE TO RELATED PATENT APPLICATIONS

The present application is a continuation of U.S. application Ser. No. 12/167,042, filed Jul. 2, 2008, which claims the benefit of U.S. Provisional Application No. 60/948,175, filed Jul. 5, 2007, both of which are incorporated by reference herein in their entireties.

BACKGROUND

The present disclosure relates generally to the field of partitions used in, for example, restrooms, to provide privacy for persons using the restroom. More specifically, the present disclosure relates to a "no-sight" partition system that inhibits or prevents a line of sight from being established from one side of a partition to another side of a partition and may include universal construction.

Various types of establishments, such as office buildings, educational facilities, recreational facilities, shopping areas, etc. typically provide areas such as restrooms, showers, changing rooms, or any of a wide variety of other types of facilities where users normally require or desire some level of privacy. In order to provide such privacy, partitions or partition systems may be used to provide areas or stalls (e.g., a bathroom stall, a shower stall, etc., a changing room, etc.) for private, individual use. A partition system typically includes one or more walls/panels, doors, and pilasters. The partition system may include generally flat panels that are fastened in a suitable fashion and provided with locks to enable people to enter/exit the stalls and ensure that others do not enter or see into a particular stall when the stall is in use.

SUMMARY

According to one embodiment, a partition system comprises a first pilaster and a door coupled to the first pilaster and rotatable from a closed position to an open position. The door is configurable in a first configuration wherein the door is rotatable from the closed position to the open position in a first direction and prevented from rotating in a second direction from the closed position, the second direction opposite the first direction. The door is further configurable in a second configuration wherein the door is rotatable from the closed position to the open position in the second direction and prevented from rotating in the first direction from the closed position. The door may be coupled to the first pilaster to define a seam and prevent a line of sight from being established through the seam.

According to another embodiment, a partition system comprises a pilaster comprising an extending portion having a first side and a second side opposite the first side, and a door configured to engage the extending portion when the door is in a closed position. The door is configurable in a first installed orientation where the door engages the first side when in the closed position. The door is further configurable in a second installed orientation where the door engages the second side when in the closed position. The door may engage the extending portion to define a seam and prevent a line of sight from being established through the seam.

According to yet another embodiment, a partition system comprises a first pilaster having a recess, a door, the door rotatably coupled to the first pilaster, a portion of the door configured to be received within the recess, and a second pilaster configured to engage the door when the door is in a closed position. The door is coupleable to the first pilaster in a first orientation such that the door rotates from the closed position to a first open position in a first direction. The door is further coupleable to the first pilaster in a second orientation such that the door rotates from the closed position to a second open position in a second direction, the second direction being opposite the first direction. The door and the first and second pilasters are configured to prevent a line of sight from being established from a first side of the door to a second side of the door at the interface of the door and the first pilaster and at the interface of the door and the second pilaster.

According to yet another embodiment, a partition system comprises a door comprising a curved portion and a pilaster comprising a recess. The door is rotatably coupled to the pilaster such that at least a portion of the curved portion is received within the recess when the door is in a closed position.

Figure 1:
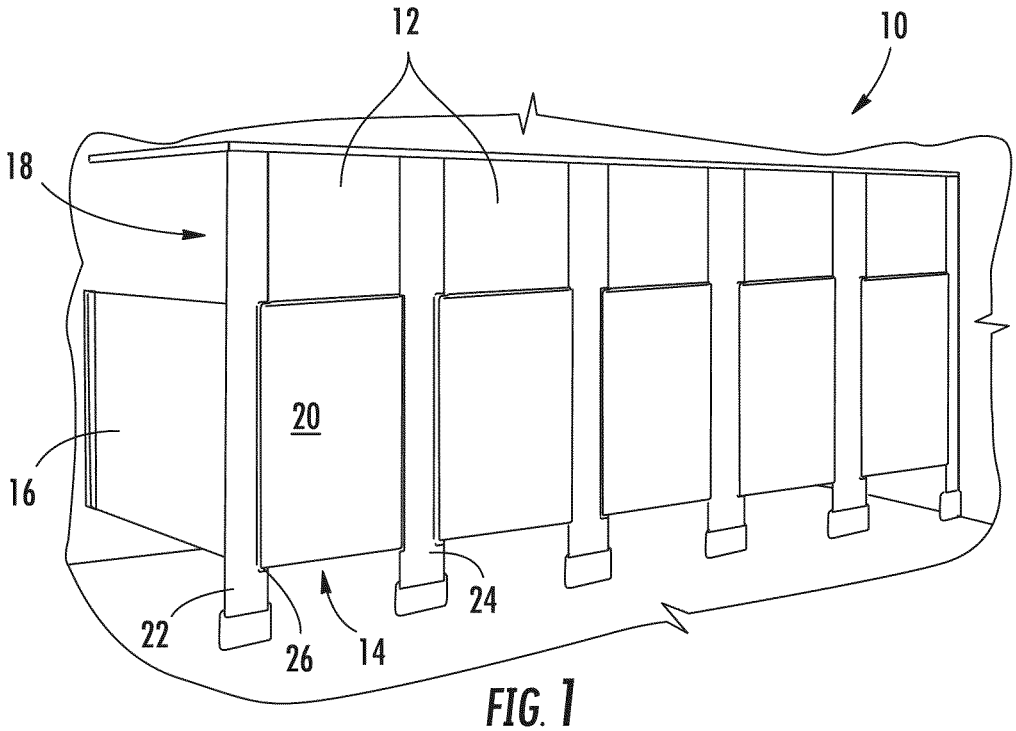
FIG. 1 is a perspective view of a facility including a number of partitioned areas or stalls according to an exemplary embodiment.

Before explaining a number of exemplary embodiments in detail, it is to be understood that the subject matter disclosed herein is not limited to the details of construction and the arrangement of the components set forth in the following description or illustrated in the drawings. The subject matter is capable of other embodiments or being practiced or carried out in various ways. It is also to be understood that the phraseology and terminology employed herein is for the purpose of description and should not be regarded as limiting.

DETAILED DESCRIPTION OF EXEMPLARY EMBODIMENTS

A partition system typically includes one or more walls/panels, doors, and pilasters. The partition system may include generally flat panels that are fastened in a suitable fashion and provided with locks to enable people to enter/exit the stalls and ensure that others do not enter or see into a particular stall when the stall is in use. One problem associated with the use of conventional partition system is that even though the door may be closed and securely locked, gaps may still exist between partition system members, and more particularly, at the "seams" between the door and the adjacent partition portions (i.e., the area where the door ends and the adjacent partition portion begins), where it may be possible to see into an individual stall from the outside area. This is particularly undesirable where privacy concerns are of high importance (e.g., with a bathroom stall).

Another problem associated with manufacturing, storing, and installing many conventional partition systems is that they have doors that open in only one direction and require separate component parts to provide a door that swings in the opposite direction (e.g., relative to the interior of a stall).

Accordingly, it would be advantageous to provide a no-sight partition system that prevents others from seeing into, for example, a bathroom stall, when the door is closed. Further, it would be advantageous to provide a universal no-sight partition system that may be configured (reconfigured, adapted, etc.) such that the door may be opened either toward or away from the interior of the stall, or with a left-handed or right-handed door swing, while minimizing the number of components for the partition.

Referring now to FIG. 1, according to an exemplary embodiment, a facility (e.g., a restroom, shower, changing room, etc.) shown as restroom 10 has a plurality of partitioned areas each shown as a stall 12 (e.g., a restroom stall, a changing room stall, a shower stall, etc.). Stall 12 is intended to provide security and privacy to users of stall 12 such that others may not enter or see into stall 12 when stall 12 is in use. While FIG. 1 shows stall 12 as a restroom stall, it should be understood that according to various alternative embodiments, stall 12 may be used in any of a variety of applications (e.g., showers, dressing rooms, etc.), and the teachings herein extend to all such applications.

As shown in FIG. 1, a number of stalls 12 may be provided adjacent one another with each stall having an interior 14. Interior 14 is generally defined by one or more sidewalls 16 and a partition 18. According to an exemplary embodiment, partition 18 includes one or more doors 20 that are provided between pilasters 22, 24 (e.g., faces, stiles, dividers, panels, wall members, etc.). For purposes of this disclosure, partition 18 will refer to door 20 and pilasters 22, 24. However, it should be understood that partition 18 may include a number of doors and/or pilasters. One or more stalls 12 may have one or more sidewalls in common (e.g., as shown in FIG. 1, several sidewalls act as a sidewall for two different stalls). Further, the walls of restroom 10 or other structures may provide at least one sidewall for stall 12.

According to one embodiment, door 20 is attached via a hinge 26 to pilaster 22 such that door 20 may be rotated from a closed position (see FIG. 2) to an open position (see FIG. 3) such that persons may enter and exit stall 12. Hinge 26 may be any suitable hinge assembly (e.g., a pin and socket, piano hinge, etc.). A handle and/or a lock or latch mechanism may also be provided such that users may lock door 20 in a closed position from interior area 14.

Figure 2:
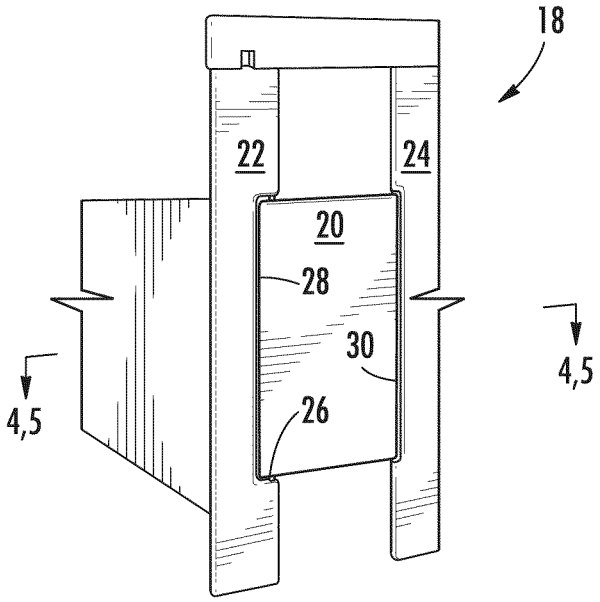
FIG. 2 is a front view of a partition with a door in a closed position according to an exemplary embodiment.
Figure 3:
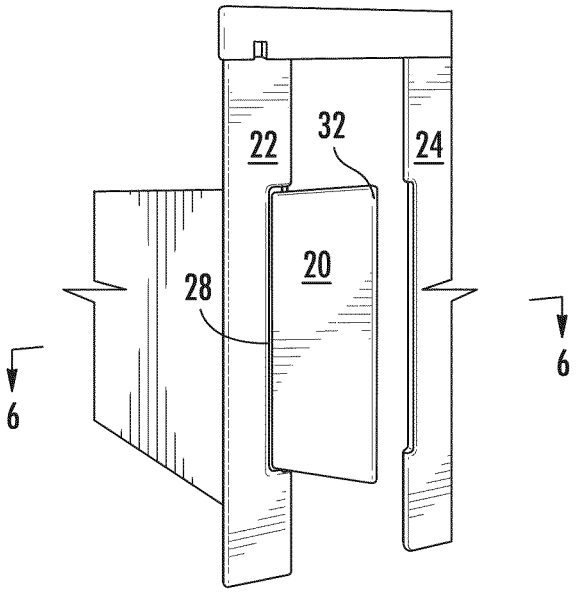
FIG. 3 is a perspective view of the partition of FIG. 2 with the door in an open position according to an exemplary embodiment.
Figure 7:
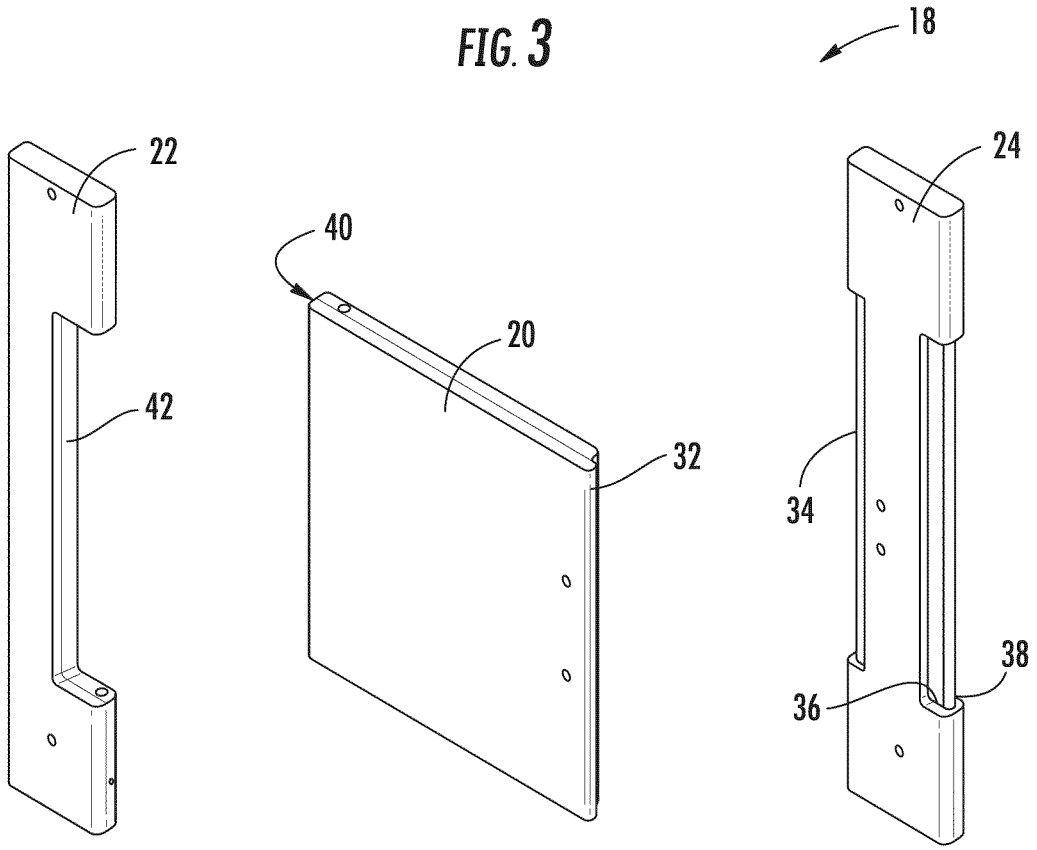
FIG. 7 is a partial exploded view of the partition of FIG. 2 according to an exemplary embodiment.
Figure 5:
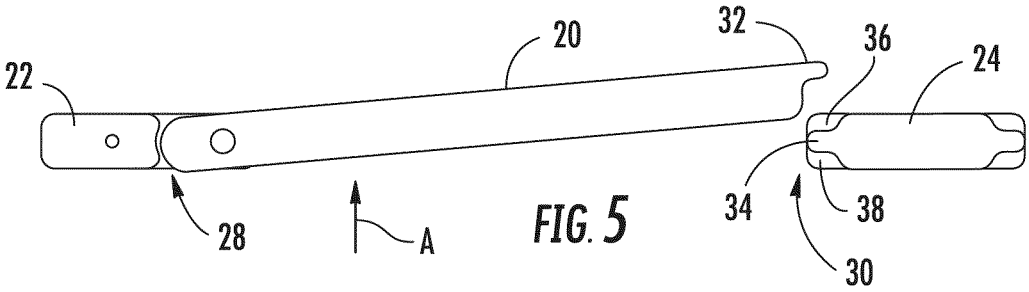
FIG. 5 is a cross-section view of the partition of FIG. 2 with the door in an open position according to an exemplary embodiment.

Referring to FIGS. 2 and 3, door 20 and pilasters 22, 24 are shown in greater detail. According to one embodiment, when door 20 is in the closed position as shown in FIG. 2, a first seam 28 is created between pilaster 22 and door 20 and a second seam 30 is created between pilaster 24 and door 20. According to an exemplary embodiment, door 20 and pilasters 22, 24 are designed such that door 20 and pilasters 22, 24 are substantially coplanar when door 20 is closed. As discussed in further detail below, a single door 20 may be installed such that it may open in either an "out-swing" fashion (e.g., such that the door swings away, or out, from interior 14 when opened, as shown in FIG. 3) or in an "in-swing" fashion (e.g., such that the door swings in toward interior 14 when opened, as shown in FIG. 5). This "universal design" is an advantage over many conventional partition systems that may be installed in only one of the out-swing or in-swing configurations, because the present design minimizes the number of parts needed to accommodate various different partition applications, thereby reducing material costs and simplifying the installation process.

Figure 4:
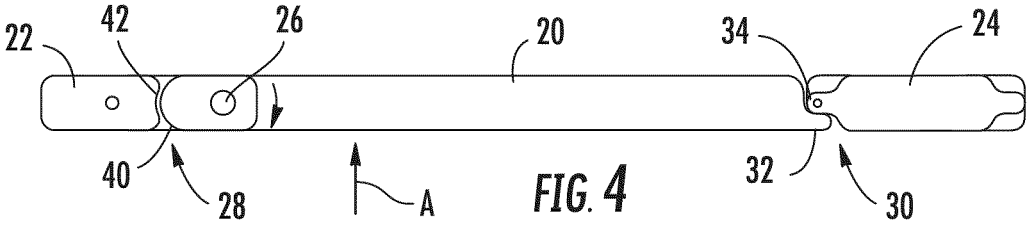
FIG. 4 is a cross-section view of the partition of FIG. 2 with the door in a closed position according to an exemplary embodiment.

Referring now to FIGS. 4-12, various interfaces between door 20 and pilasters 22, 24 are shown in greater detail. Referring to FIG. 4, partition 18 is provided such that arrow A represents a line of sight from outside a stall (e.g., from the outside looking in). Partition 18 is a "no-sight" partition in that door 20 and pilasters 22, 24 close at seams 28, 30 such that there is no line of sight through seams 28, 30 when door 20 is in the closed position. When a user fully closes door 20 and is within interior area 14, no one from outside stall 12 may see into interior portion 14 through seams 28, 30. This "no-sight" feature is an advantage over many conventional partitioning systems that leave gaps at the seams, thereby potentially compromising the privacy and security of users.

Figure 6:
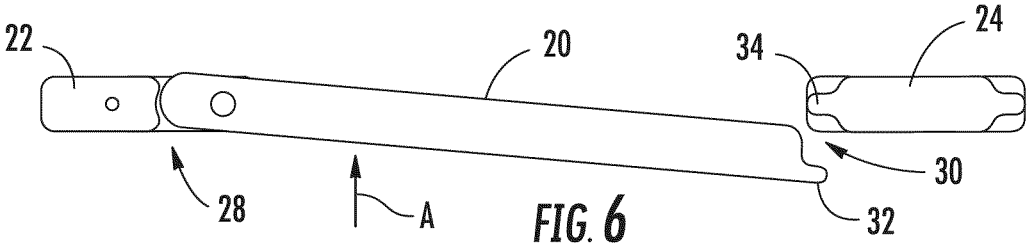
FIG. 6 is a cross-section view of the partition of FIG. 3 with the door in an open position according to an exemplary embodiment.

As shown in FIGS. 4-6, door 20 may include a first member or lip 32 (e.g., a rail, extension, projection, etc.) that according to one embodiment, may extend along a portion or all of the length of door 20. Lip 32 on door 20 may be configured to engage a corresponding second member or stop 34 (e.g., an extension, rail, etc.) provided on pilaster 24. According to one embodiment, stop 34 may be formed by two grooves 36, 38 (see FIG. 5) that are formed into pilaster 24 and may be generally symmetric about a mid-section of pilaster 24. As shown in FIG. 4, when door 20 is closed, lip 32 overlaps with stop 34 along the length of seam 30 such that it is not possible to see "through" partition 18 (e.g., in the direction represented with arrow A in FIGS. 4-6, between adjoining or adjacent panels or members of the stall).

Furthermore, the overlap of lip 32 and stop 34 permit door 20 to be opened in only a single direction. For example, as shown in FIG. 5, door 20 is in the in-swing position, while as shown in FIG. 6, door 20 is in the out-swing position. Door 20 and pilaster 24 are universal in design and may be moved from the in-swing position to the out-swing position by removing door 20 from partition 18, flipping door 20 over (e.g., such that the top edge becomes the bottom edge), and reinstalling door 20.

Door 20 may further include a contoured portion 40 (e.g., a convex portion, a curved portion, etc.) that rotates relative and adjacent to a correspondingly contoured portion 42 (e.g., a concave portion, a curved portion, etc.) on pilaster 22. Contoured portions 40, 42 are designed such that in contrast to right-angled door and pilaster members, where a gap may permit a line of sight through partition 18 at seam 28, no line of sight may be established at seam 28 because of the corresponding contoured portions 40, 42 of door 20 and pilaster 22. As shown in FIGS. 5 and 6, contoured portions 40, 42 are universally designed such that they may be used in either the in-swing or out-swing positions.

According to another exemplary embodiment, partition 18 is configured to facilitate changing partition 18 from having a right-handed swinging door to having a left-handed swinging door. For example, as shown in FIG. 3, door 20 is in the left-handed position, such that it swings about hinge portion 26 along the left edge of door 20 (as viewed from outside a typical stall). Partition 18 may be reconfigured to provide a right-handed door by exchanging the positions of pilasters 22 and 24 and reinstalling door 20 in a rotated position (e.g., such that the left edge becomes the right edge as shown in FIG. 3). This may be particularly advantageous in applications where flipping door 20 is not possible (e.g., in cases where the top and bottom edges of door 20 are unique from each other and are not functionally interchangeable). According to various exemplary embodiments, partition 18 may be assembled in a variety of in-swing/out-swing and left-handed/right-handed configurations to suit various applications.

While FIGS. 4 and 5 show specific embodiments of partition 18 and the interfaces between door 20 and pilasters 22, 24, it should be understood that a wide variety of configurations may be used to provide a no-sight partition such as partition 18. FIGS. 8-13 shows various alternative configurations for partition 18.

Figure 8:
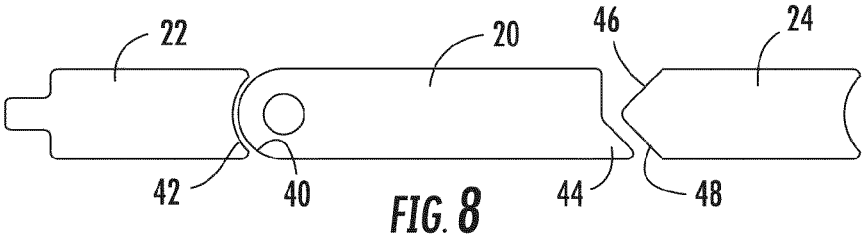
FIG. 8 is a cross-section view of a partition according to an exemplary embodiment.
Figure 9:
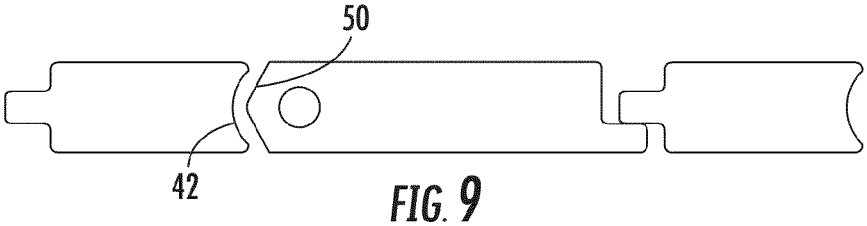
FIG. 9 is a cross-section view of a partition according to an exemplary embodiment.
Figure 10:
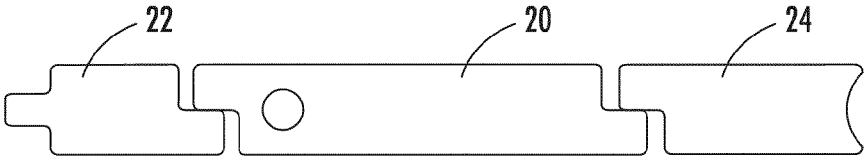
FIG. 10 is a cross-section view of a partition according to an exemplary embodiment.

For example, referring to FIG. 8, door 20 may include a generally triangular-shaped projection 44 intended to engaged one of two correspondingly shaped surfaces 46, 48. As shown in FIG. 9, rather than contoured portion 40 having a smooth radius, a polygonal profile may be provided such as a portion 50 that maintains the no-sight and universal characteristics of partition 18 discussed in greater detail above. FIG. 10 illustrates a door and pilaster configuration where door 20 may be installed in and operate in only one of the in-swing and out-swing positions.

Figure 11:
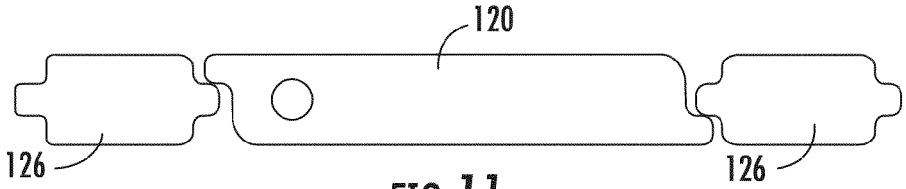
FIG. 11 is a cross-section view of a partition according to an exemplary embodiment.
Figure 12:
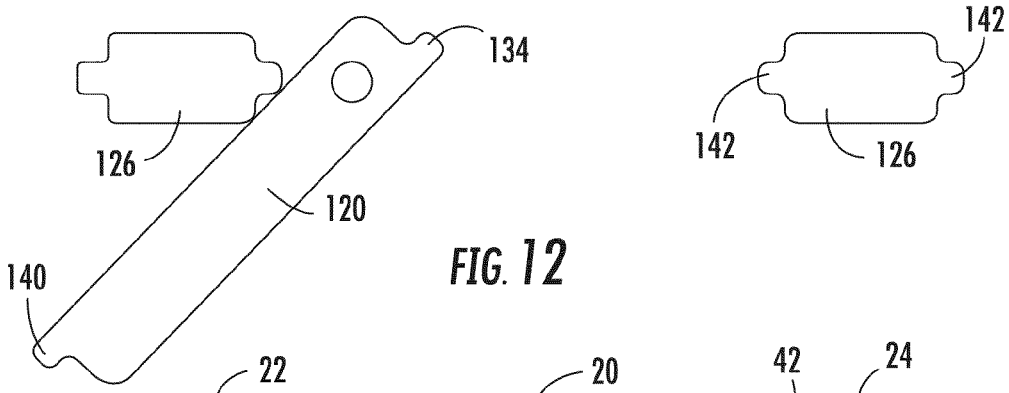
FIG. 12 is a cross-section view of the partition of FIG. 11 in an open position according to an exemplary embodiment.

Referring to FIGS. 11 and 12, yet another embodiment of a partition 18 is illustrated. As shown in FIGS. 11 and 12, a door 120 includes a contoured portion or lip 134 and a contoured portion 140. Portions 134 and 140 are similarly shaped such that only a single pilaster configuration, such as a pilaster 126 having two contoured portions 142, is required to engage both sides of door 120. This further reduces the number of components involved in partition 18 and the associated material costs.

Figure 13:
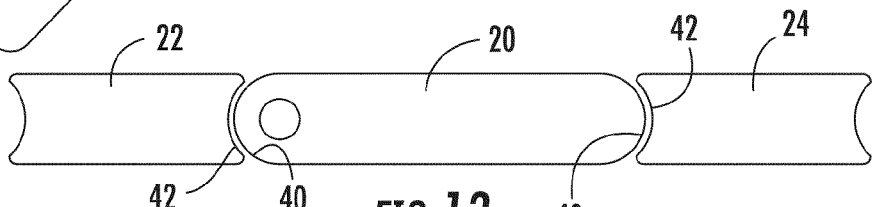
FIG. 13 is a cross-section view of a partition according to an exemplary embodiment.

Referring to FIG. 13, another embodiment of partition 18 is illustrated according to another exemplary embodiment. As shown in FIG. 13, door 20 may include contoured portion 40 on both edges (e.g., left and right edges as facing door 20 in an installed position). Pilasters 22 and 24 may each include corresponding contoured portions 42 on one or both sides or edges. In this manner, both door 20 and pilaster 22, 24 may be generally symmetrical in shape. Furthermore, pilasters 22, 24 may be interchangeable and in some embodiments, may be identical.

According to various other alternative embodiments, other component configurations (e.g., shapes, sizes, etc.) may be used in forming partition 18. Furthermore, the locations of the various interface portions (e.g., the lip, stop, contours, etc.) may be varied (e.g., reversed, etc.). For example, a single pilaster may be configured to have two stop portions, two hinge portions, one stop portion and one hinge portion, etc., depending on the particular application.

It should be understood that the FIGURES are not shown to scale and that the sizing (e.g., length, width, etc.) of the various components (e.g., the door, pilasters, etc.) may be varied to suit particular applications. Further, it is important to note that for purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the no-sight partition as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present disclosure as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the exemplary embodiments without departing from the spirit of the present disclosure as expressed in the appended claims.

What is claimed is:

1. A lavatory partition system comprising:

a first pilaster comprising a first major surface, a second major surface opposite the first major surface, and a first lateral surface extending between the first and second major surfaces, the first lateral surface comprising a recess, the recess being generally symmetric about a centerline between the first and second major surfaces of the first pilaster;

a second pilaster;

a door coupled to the first pilaster and rotatable between a closed position and an open position, the door comprising:

a first substantially planar major surface;

a second substantially planar major surface opposite the first major surface; and a first lateral convex surface extending from an edge of the first substantially planar major surface and to an edge of the second substantially planar major surface, the first lateral convex surface defining a projection;

a second lateral surface extending between the first and second major surfaces such that when the door is in the closed position the second lateral surface is adjacent to the second pilaster, and when the door is in the open position the second lateral surface is spaced apart from the second pilaster;

wherein at least a portion of the projection on the door extends into the recess on the first pilaster to define a seam and prevents a line of sight from being established through the seam when the door is in the closed position;

wherein the projection on the door rotates within the recess as the door rotates between opened and closed positions.

2. The lavatory partition system of claim 1 wherein the first lateral surface on the first pilaster is a curved surface.

3. The lavatory partition system of claim 2 wherein the first lateral surface on the first pilaster intersects the first major surface on the first pilaster along a first edge and intersects the second major surface on the first pilaster along a second edge, wherein the recess on the first pilaster is recessed from the first edge and the second edge.

4. The lavatory partition system of claim 3 wherein the first lateral surface on the first pilaster is substantially concave.

5. The lavatory partition system of claim 1 wherein the projection on the first lateral surface on the door is a convex surface.

6. The partition system of claim 1 wherein the projection on the first lateral surface on the door is defined by a pair of linear surfaces meeting at a ridge.

7. The partition system of claim 1 further comprising a second pilaster, the second pilaster comprising:

a first major surface;

a second major surface opposite the first major surface; and a first lateral surface extending between the first and second major surfaces, the first lateral surface comprising a recess;

wherein the door further comprises a convex second lateral surface extending between the first and second major surfaces on the door, the convex second lateral surface at least partially received within the recess on the second pilaster when the door is in the closed position.

8. A lavatory partition system comprising:

a first pilaster comprising a first major surface, a second major surface opposite the first major surface, and a concave first lateral surface extending between the first and second major surfaces;

a second pilaster;

a door coupled to the first pilaster and rotatable between a closed position and an open position, the door comprising:

a first major surface;

a second major surface opposite the first major surface; and a first lateral surface extending from the first major surface and to the second major surface, the first lateral surface comprising a projection;

a second lateral surface extending between the first and second major surfaces such that when the door is in the closed position the second lateral surface is adjacent to the second pilaster, and when the door is in the open position the second lateral surface is spaced apart from the second pilaster;

wherein at least a portion of the projection on the door extends into the concave first lateral surface on the first pilaster to define a seam and prevents a line of sight from being established through the seam when the door is in the closed position;

wherein the projection on the door rotates within the concave first lateral surface on the first pilaster as the door rotates between opened and closed positions;

wherein the concave first lateral surface on the first pilaster is configured to enable a user to move the door from the closed position in both a first direction and a second direction opposite the first direction, the concave first lateral surface being generally symmetric about a plane extending parallel to one of the first and second major surfaces of the first pilaster and through the axis of rotation of the door.

9. The lavatory partition system of claim 8 wherein the concave first lateral surface on the first pilaster intersects the first major surface on the first pilaster along a first edge and intersects the second major surface on the first pilaster along a second edge, wherein the concave first lateral surface on the first pilaster is recessed from the first edge and the second edge.

10. The lavatory partition system of claim 8 wherein the projection on the first lateral surface on the door is a convex surface extending between an edge of a planar portion of the first major surface of the door and an edge of a planar portion of the second major surface of the door.

11. The partition system of claim 8 wherein the projection on the first lateral surface on the door is defined by a pair of linear surfaces meeting along a ridge.

12. The partition system of claim 8 further comprising a second pilaster, the second pilaster comprising:

a first major surface;

a second major surface opposite the first major surface, and a concave first lateral surface extending between the first and second major surfaces wherein the door further comprises a convex second lateral surface extending between the first and second major surfaces on the door, the convex second lateral surface at least partially received within the recess on the second pilaster when the door is in the closed position.

13. A lavatory partition system comprising:

a first pilaster comprising:

a first major surface;

a second major surface opposite the first major surface;

a concave first lateral surface extending between the first and second major surfaces, wherein the concave first lateral surface intersects the first major surface along a first edge and intersects the second major surface along a second edge, wherein the concave first lateral surface on the first pilaster is recessed within the first pilaster from the first edge and the second edge and is symmetric about a centerline between the first major surface of the first pilaster and the second major surface of the first pilaster;

a second pilaster comprising a recess;

a door coupled to the first pilaster and rotatable between a closed position and an open position, the door comprising:

a first major surface;

a second major surface opposite the first major surface;

a convex first lateral surface extending between the first and second major surfaces; and a convex second lateral surface extending between the first and second major surfaces;

wherein the convex first lateral surface on the door extends into the concave first lateral surface on the first pilaster portion to define a seam and prevents a line of sight from being established through the seam when the door is in the closed position;

wherein the convex first lateral surface on the door rotates within the concave first lateral surface on the first pilaster as the door rotates between opened and closed positions;

wherein the convex second lateral surface on the door is at least partially received within the recess on the second pilaster when the door is in the closed position; and wherein the convex second lateral surface on the door is spaced apart from the second pilaster when the door is in the open position.

14. The partition system of claim 13 further comprising a second pilaster, the second pilaster comprising a first major surface, a second major surface opposite the first major surface on the second pilaster, and a concave first lateral surface extending between the first and second major surfaces on the second pilaster;

wherein the door further comprises a convex second lateral surface extending between the first and second major surfaces on the door, the convex second lateral surface on the door at least partially received within the recess on the second pilaster when the door is in the closed position.

* * * * *